US005806147A

United States Patent [19]

Sato

[11] Patent Number: 5,806,147

[45] Date of Patent: Sep. 15, 1998

[54] CLIP

[76] Inventor: Hisao Sato, Fujimidai Mansion 2002, 29-10, Nukui 1-chome, Nerima-ku, Tokyo, Japan

[21] Appl. No.: 876,431

[22] Filed: Jun. 16, 1997

[51] Int. Cl.[6] ..... A44B 21/00; B42F 1/00

[52] U.S. Cl. ..... 24/67.9; 24/67 R; 24/545; 24/563; 24/67.5

[58] Field of Search ..... 24/67.9, 67 R, 24/67.5, 67.3, 563, 545

[56] References Cited

U.S. PATENT DOCUMENTS

| | | | |
|---|---|---|---|
| 1,429,182 | 9/1922 | Ashley . | |
| 1,493,072 | 5/1924 | Fricker | 24/563 |
| 1,603,504 | 10/1926 | Baltzley . | |
| 1,675,286 | 6/1928 | Valkenburg | 24/563 |
| 1,865,453 | 7/1932 | Baltzley | 24/545 |
| 2,601,435 | 6/1952 | Einhorn et al. | 24/563 |
| 4,332,060 | 6/1982 | Sato | 24/67.5 |
| 4,532,680 | 8/1985 | Hashimoto . | |
| 4,735,438 | 4/1988 | Demarest, Jr. . | |
| 4,765,335 | 8/1988 | Schmidt et al. | 24/545 |
| 4,946,065 | 8/1990 | Goulter et al. . | |
| 5,533,236 | 7/1996 | Tseng | 24/67.9 |

FOREIGN PATENT DOCUMENTS

| | | | |
|---|---|---|---|
| 0658961 | 5/1965 | Belgium | 24/67 R |

*Primary Examiner*—Victor N. Sakran
*Attorney, Agent, or Firm*—Kanesaka & Takeuchi

[57] ABSTRACT

A clip made from a band-like metal plate having spring characteristics, includes: a back portion formed at a center portion of the metal plate in its longitudinal direction so as to have a width in the longitudinal direction corresponding to a maximum clipping thickness of the clip; a pair of abutment portions formed by bending the band-like metal plate in the same direction at longitudinally opposite ends of the back portion so that longitudinal opposite ends of the respective abutment portions form abutting edges which abut against each other for holding edge portions of sheet-like members to be clipped between the abutting edges of the abutment portions; and at least three bent portions for giving an elastic force to the abutment portions.

10 Claims, 6 Drawing Sheets

CLIP

BACKGROUND OF THE INVENTION

1. Field of the Invention

The present invention relates to a clip for clipping sheets of paper or thin plate-like members, and particularly relates to a clip which is produced through a process in which a band-like metal plate is bent so as to make its longitudinally opposite end portions abut against each other to clip sheets of paper or thin plate-like members between these longitudinally opposite end portions.

2. Description of the Related Art

To clip loose paper sheets of documents, pamphlets, thin plate-like members of synthetic resin, or the like (hereinafter simply referred to as "sheet-like members"), there has been broadly used a Gem Clip (trade name) which is produced through a process in which metal wire or the like is wound to form double ring-like portions so that documents can be held between these ring-like portions. Such a Gem Clip has no problem when the number of sheets of the documents to be clipped is small. When the number of sheets of the documents is increased, however, a Gem Clip is not suitable to clip such a thick stack of documents.

Therefore, there has been provided a clip with finger grips called a double clip which is produced through a process in which elastic thin-plate metal such as steel material is formed into a band-like plate, and the band-like plate is bent so that a back portion having a length in the longitudinal direction of the metal plate (hereinafter referred to as "width"), corresponding to the maximum thickness of a stack of materials which can be clipped (hereinafter referred to as "maximum clipping thickness") is disposed substantially at the longitudinal center of the band-like metal plate, and abutment portions are disposed on the opposite sides of the back portion so that the abutment portions are bent substantially perpendicularly at the longitudinally opposite end portions of the back portion so as to abut against each other elastically at the forward ends thereof, that is, at the abutting edges. Thus, the back portion and the abutment portions constitute a body portion of the clip. Further, two finger grips formed of metal wires are attached to the body portion in a manner such that the opposite ends of each of the finger grips are rotatably inserted into ring-like lock portions formed by bending edge portions of respective the abutment portions. In use of this clip, free ends of the two finger grips are gripped and rotated with fingers in the direction to make the free ends come close to thereby spread the nip between the abutting edges of the abutment portions to clip documents or the like between the abutting edges.

The present inventor disclosed, in U.S. Pat. No. 4,353,157 and U.S. Pat. No. 4,966,755, a clip formed of a sheet of elastic plate-like member and having a back portion disposed substantially at the longitudinal center of the plate-like member with a width corresponding to the maximum clipping thickness, and a pair of abutment portions formed by bending the plate-like member in the same direction at the longitudinally opposite end portions of the back portion so that the forward or free end portions, that is, the abutting edges of the respective abutment portions abut against each other elastically, lug portions provided at the opposite abutting edge side portions of each of the abutment portions to project perpendicularly to the longitudinal direction of the plate like member; and further disclosed a clip driver for driving such a clip as mentioned above to open the abutting edges of this clip to clip documents or the like between the clipping portions. Such clips and drivers disclosed in U.S. Pat. No. 4,353,157 and U.S. Pat. No. 4,966,755 are used now broadly and practically. This clip driver is constituted by: a body case having a clip insertion port formed at its rear end side, an aperture formed at its front end side for inserting end portions of sheet-like members to be clipped, and a clip path which lies from the clip insertion port to the aperture so that a plurality of clips can be installed therein; a knob disposed slidably in this body case so that the knob pushes out a clip from the aperture when a sliding force is applied to the knob; and opening springs disposed in the clip path near the aperture so that the springs are inserted between the lug portions of the thus pushed clip to open the abutment portions through the lug portions.

In use, it will go well if the knob is made to slide forward after end portions of sheet-like members to be clipped are inserted into the aperture of the clip driver. Consequently, the clip at the head portion is pushed toward the aperture by the knob, and the abutment portions of the clip are opened by the opening springs. After the upper and lower surfaces of the end portions of the sheet-like members inserted into the aperture are positioned between the abutment portions of the clip, the knob is made to go ahead further to make the lug portions of the clip separate from the opening springs. If the clip is released from the aperture, the sheet-like members are in the state where the end portions of the sheet-like members are clipped by the clip between its abutment portions.

Since such a clip with finger grips as mentioned above is made from steel which is superior in spring characteristics, its bent portions are large in restoring force so that, even after the clip has clipped, for a long time, a number of sheet-like members of a stack thickness substantially corresponding to the maximum clipping thickness, the clip can show an enough elastic force to make the abutting edges of the abutment portions abut against each other again when the clip is removed from the sheet-like members. However, steel gets rusty easily due to the moisture of paper or the like. Accordingly, it is necessary to give the surface treatment, for example, plating with chrome, etc., on steel. When the plating is imperfect at a part, rust is generated in the part, and the rust deposits on the clipped sheet-like members if the clip is left as it is in the state of use for a long time. Therefore, perfect plating is required, so that it takes long time to manufacture such clips, and the products become expensive.

On the other hand, clips driven by the clip driver are made of stainless steel for preventing the problem of rust. Stainless steel has an advantage of being difficult to get rusty. Accordingly, such clips made of stainless steal can be shipped as products with no surface treatment for preventing rust so long as a plate of stainless steel is punched by pressing or the like and the cut surface is polished in accordance with necessity. Accordingly, there is another advantage that such clips can be manufactured more easily and more inexpensively than those made of steel. However, stainless steel is lower in the spring characteristic than steel, and hence smaller in restoring force at bent portions than steel. Therefore, settling arises in the bent portions when a number of sheet-like members with a stack thickness near the maximum clipping thickness are clipped, so that there may be a case where the abutting edges of abutment portions do not contact with each other when the sheet-like members are removed, and a small gap is caused between the abutting edges so that the clip becomes impossible to clip a small number, such as two or three, of sheet-like members.

SUMMARY OF THE INVENTION

Taking such a foregoing actual situation of conventional techniques into consideration, it is a first object of the present invention to provide a metal-plate clip which can be made from a metal plate low in spring characteristic, and in which settling hardly occurs in the bent portions even if sheet-like members having a stack thickness near the maximum clipping thickness are clipped by the clip.

It is a second object of the present invention to provide a clip which can be opened with a clip opening force smaller than that in the conventional one.

It is a third object of the present invention to provide a clip which can clip sheet-like members of a stack thickness near the maximum clipping thickness even if the clip is made from a metal plate lower in spring characteristic than steel, and in which abutment portions can abut against each other tightly even after the sheet-like members are removed.

In order to achieve the first to third objects mentioned above, according to a first aspect of the present invention, provided is a clip made from a band-like metal plate having spring characteristics, comprising: a back portion formed at a center portion in a longitudinal direction of the metal plate so as to have a width in the longitudinal direction corresponding to a maximum clipping thickness of the clip; a pair of abutment portions formed by bending the band-like metal plate in the same direction at longitudinally opposite ends of the back portion so that longitudinal opposite ends of the respective abutment portions form abutting edges which abut against each other for holding edge portions of sheet-like members to be clipped between the abutting edges of the abutment portions; and at least three bent portions for giving an elastic force to the abutment portions.

In order to achieve the first to third objects mentioned above, according to a second aspect of the present invention, in the above configuration of the clip according to the first aspect of the invention, the bent portions include first, second, third and fourth bent portions, the first and second bent portions being formed at borders between the longitudinally opposite ends of the back portion and the pair of abutment portions following the back portion, third and fourth bent portions being formed at portions in the respective abutment portions away from the first and second bent portions by equal distances respectively.

In order to achieve the first to third objects mentioned above, according to a third aspect of the present invention, in the above configuration of the clip according to the first aspect of the invention, an interior angle of each of the third and fourth bent portions is obtuser than an interior angle of each of the first and second bent portions.

In order to achieve the first to third objects mentioned above, according to a fourth aspect of the present invention, in the above configuration of the clip according to the first aspect of the invention, the bent portions include first, second, third and fourth bent portions, the first and second bent portions being formed in borders between the longitudinally opposite ends of the back portion and the pair of abutment portions following the back portion, the third and fourth bent portions being formed at a distance substantially in a center portion of the back portion.

In order to achieve the first to third objects mentioned above, according to a fifth aspect of the present invention, in the above configuration of the clip according to the first aspect of the invention, the bent portions include first, second and third bent portions, the first and second bent portions being formed in borders between the longitudinally opposite ends of the back portion and the pair of abutment portions following the back portion, the third bent portion being formed into a mountain-like shape projecting outward substantially at a center of the back portion.

In order to achieve the first to third objects mentioned above, according to a sixth aspect of the present invention, in the above configuration of the clip according to the first aspect of the invention, the bent portions include first, second, third, fourth and fifth bent portions, the first and second bent portions being formed in borders between the longitudinally opposite ends of the back portion and the pair of abutment portions following the back portion, the third and fourth bent portions being formed at a distance substantially in a center portion of the back portion, the fifth bent portion being formed into a mountain-like shape projecting outward substantially at a center of the back portion.

In order to achieve the third object mentioned above, according to a seventh aspect of the present invention, in the above configuration of the clip according to the first aspect of the invention, the metal plate is made from stainless steel.

DETAILED DESCRIPTION OF THE PREFERRED EMBODIMENTS

Embodiments of the present invention will be described with reference to the accompanying drawings. In the following respective embodiments, parts substantially equivalent to each other are referenced correspondingly, and repeated description about these parts is omitted suitably.

Figure 1:
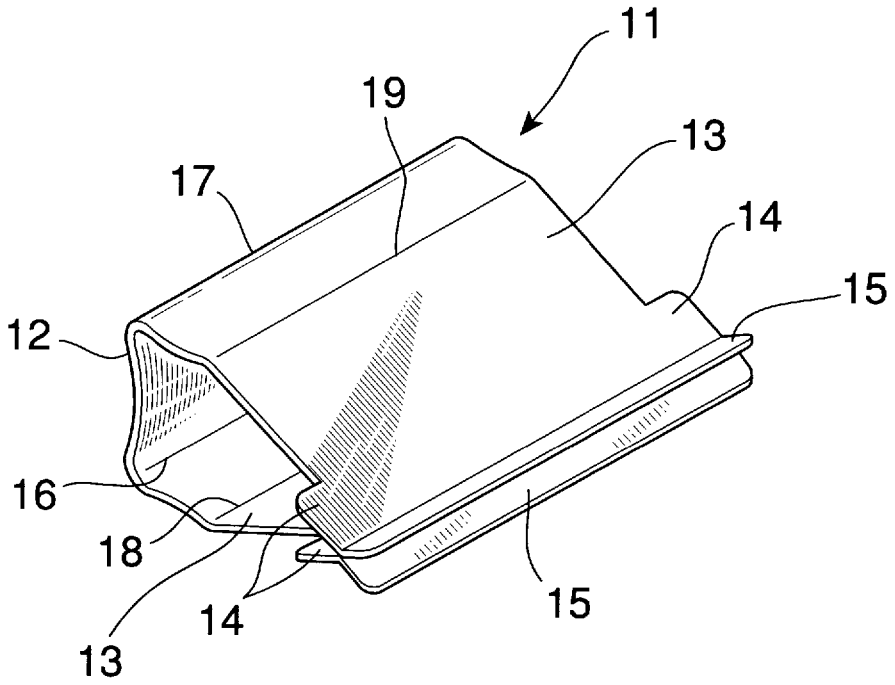
FIG. 1 is a perspective view illustrating a clip according to a first embodiment of the present invention.
Figure 2:
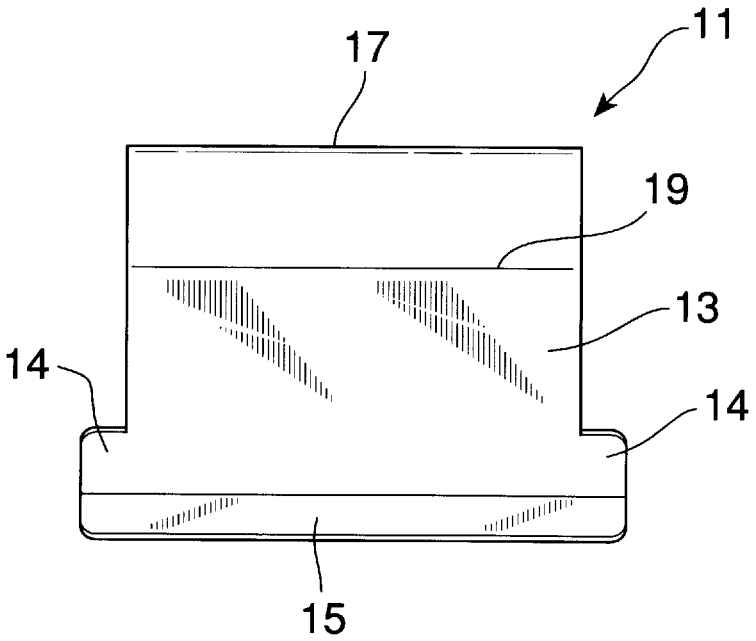
FIG. 2 is a plan view of the clip according to the first embodiment.
Figure 3:
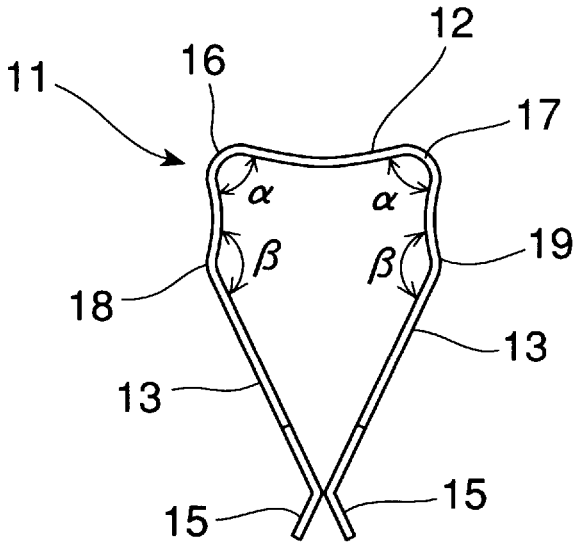
FIG. 3 is a side view of the clip according to the first embodiment.
Figure 4:
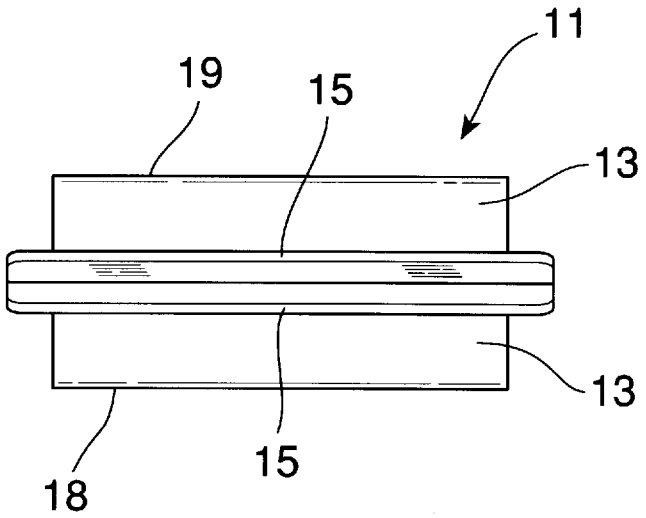
FIG. 4 is a bottom view of the clip according to the first embodiment.
Figure 5:
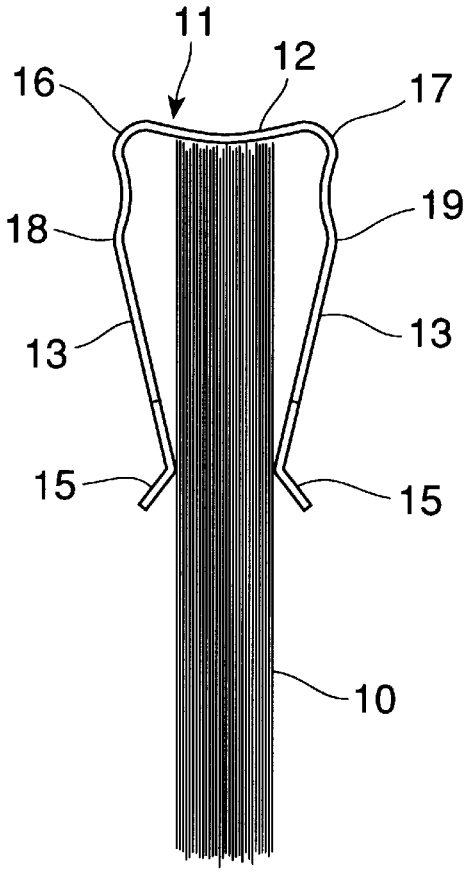
FIG. 5 is a perspective view illustrating the state where documents are clipped by the clip according to the first embodiment.

A first embodiment shown in FIGS. 1 to 5 will be described first. FIG. 1 is a perspective view illustrating a clip according to the first embodiment of the present invention; FIG. 2 is a plan view of the clip according to the first embodiment; FIG. 3 is a side view of the clip according to the first embodiment; FIG. 4 is a bottom view of the clip according to the first embodiment; and FIG. 5 is a perspective view illustrating the state where documents are clipped by the clip according to the first embodiment.

A clip 11 in the first embodiment shown in FIGS. 1 to 5 is an improved one of the clips used for the above-mentioned clip driver disclosed in U.S. Pat. No. 4,353,157 and U.S. Pat. No. 4,966,755. The clip 11 is constituted by: a back portion 12 which is formed at a longitudinal center of a band-like metal plate made from stainless steel by bending the band-like metal plate so that the back portion 12 is curved inward and has a width in the longitudinal direction of the belt-like metal plate corresponding to the maximum thickness of materials to be clipped by the clip 11, that is, the maximum clipping thickness of the clip 11; a pair of abutment portions 13 which are formed by further bending the belt-like metal plate in the same direction at the opposite ends of the back portion 12 respectively so that the abutment portions 13 elastically abut against each other at their abutting edges, each of the abutment portions 13 having a pair of lug portions 14 formed at its opposite sides on its longitudinally end portion so as to project outward perpendicularly thereto; and guide portions 15 formed by further bending outward the respective abutment portions 13 at their longitudinally end portions each including the lug portions 14 so that the clip 11 can be easily opened at the guide portions 15 when materials are to be clipped between the abutment portions 13 of the clip 11.

Four bent portions are formed in this first embodiment so as to give an elastic force to the respective abutment portions 13 so that the abutment portions 13 are made to abut against each other at their abutting edges between the abutment portions 13 and the guide portions 15 respectively. That is, first and second bent portions 16 and 17 are formed in the borders between the back portion 12 and the abutment portions 13 following the back portion 12 respectively, and third and fourth bent portions 18 and 19 are formed in the respective abutment portions 13 at equal distances away from those first and second bent portions 16 and 17 respectively. As shown in detail in FIG. 3, of these four bent portions 16–19, an interior angle $\alpha$ forming each of the first and second bent portions 16 and 17 is acuter than an interior angle $\beta$ forming each of the third and fourth bent portions 18 and 19. In other words, the interior angle $\beta$ forming each of the third and fourth bent portions 18 and 19 is obtuser than the interior angle $\alpha$ forming each of the first and second bent portions 16 and 17.

Consequently, the respective abutment portions 13 are given a strong elastic force by means of the first and second bent portions 16 and 17 so as to abut against each other, and are further given, by means of the third and fourth bent portions 18 and 19, an elastic force which is weak but sure to make the abutment portions 13 abut against each other. In such a manner, two stages of elastic forces caused by the first and third bent portions 16 and 18 are given to one of the abutment portions 13, and two stages of elastic forces caused by the second and fourth bent portions 17 and 19 are given to the other abutment portion 13, so that an enough gap to clip sheet-like members 10 piled up to a thickness substantially equal to the maximum clipping thickness of the clip limited by the width of the back portion 12 can be formed without opening these bent portions 16 to 19 to the full extent when the abutment portions 13 are opened in the case where the sheet-like members are to be clipped.

In such a configuration, the elastic force to make the abutment portions 13 abut against each other can be generated by the bent portions formed in the respective abutment portions 13, by two for each abutment portion, that is, by four in total. Therefore, an elastic force required for each of the bent portions may be only a quarter of the required total elastic force. Therefore, if the elastic force of each of the bent portions is set to be about a little larger than a quarter of the required total elastic force, the respective bent portions 16 to 19 can be opened with some strength left. Accordingly, there is no fear that settling is generated in the respective bent portions 16 to 19 even if the respective abutment portions 13 are opened up to become parallel to each other in order to clip the sheet-like members 10 piled up to a thickness substantially equal to the maximum clipping thickness. As a result, the original elastic force can be given immediately after the opening force is released, and the abutting edges of the respective abutment portions 13 of the clip 11 are made abut against each other tightly again even when the sheet-like members 10 which are thick substantially equal to the maximum clipping thickness and which have been clipped in the clip 11 are removed from the clip 11, with no fear that any gap is generated between the abutting edges of the abutment portions 13. Therefore, the clip having no settling can be formed from stainless steel which is lower in elastic force but easier in post-treatment than steel, so that the clip can be provided inexpensively.

In addition, because an elastic force required for each bent portion may be a little stronger than a quarter of the required total elastic force, the force to open the abutment portions 13 to be positioned substantially parallelly to each other may be smaller than that in a conventional clip, and the opening resistance against the spring force of opening springs of a clip driver becomes smaller, so that the fatigue of the opening springs can be reduced. Further, since the interior angle $\beta$ forming each of the third and fourth bent portions 18 and 19 is made to be obtuser than the interior angle $\alpha$ forming each of the first and second bent portions 16 and 17, the abutting edges of the abutment portions 13 can press down the surface of the sheet-like members 10 with a soft elastic force, so that the sheet-like members 10 can be clipped without being injured.

Figure 6:
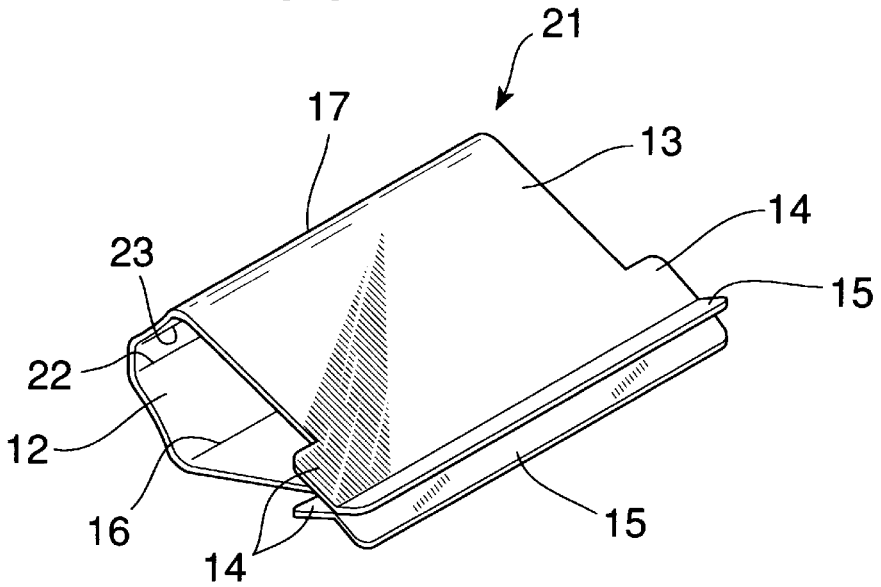
FIG. 6 is a perspective view illustrating a clip according to a second embodiment of the present invention.

Next, a second embodiment will be described with reference to FIG. 6. FIG. 6 is a perspective view illustrating a clip according to the second embodiment. In a clip 21 according to the second embodiment, a flat-top mountain-like vertex portion projecting outward is formed substantially at the center of a back portion 12, so that third and fourth bent portions 22 and 23 are formed in the borders between the flat-top mountain-like vertex portion and inclined sides on the opposite sides of the vertex portion. These third and fourth bent portions 22 and 23 are designed so that the interior angle forming each of the first and second bent portions 16 and 17 is acuter than the interior angle forming each of the third and fourth bent portions 22 and 23 similarly to the above-mentioned clip according the first embodiment. Also with this structure, an effect similar to that in the first embodiment can be obtained.

Figure 7:
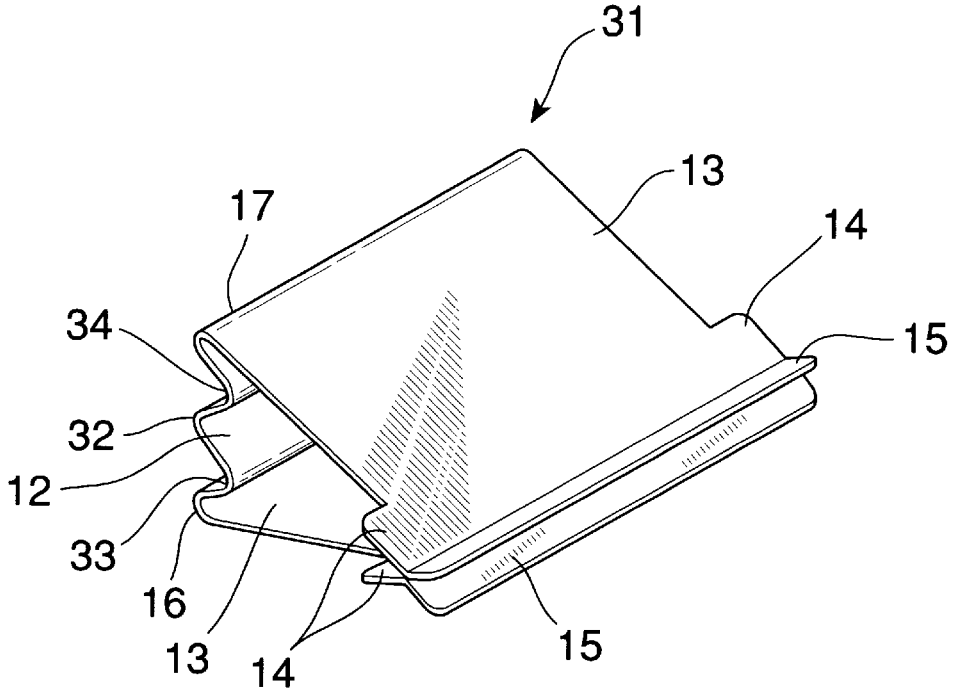
FIG. 7 is a perspective view illustrating a clip according to a third embodiment of the present invention.

Next, a third embodiment shown in FIG. 7 will be described. FIG. 7 is a perspective view illustrating a clip according to the third embodiment. In a clip 31 according to the third embodiment, a mountain-like convex strip 32 projecting outward is provided substantially at the center portion of a back portion 12, and valley-like concave strips 33 and 34 are formed between the convex strip 32 and the first and second bent portions 16 and 17, respectively. Consequently, three wave portions are formed in the back portion 12, so that an elastic force to make abutment portions 13 abut against each other is given by means of these three wave portions. Therefore, if each of these three wave portions is bent in advance to generate an elastic force which is substantially a little stronger than one third of the required total elastic force, the respective bent portions can be opened still with some strength left so that there is no fear that settling is generated in the respective bent portions, even if an opening force is given to the bent portions so that the abutment portions 13 are opened up to become substantially parallel to each other.

Figure 8:
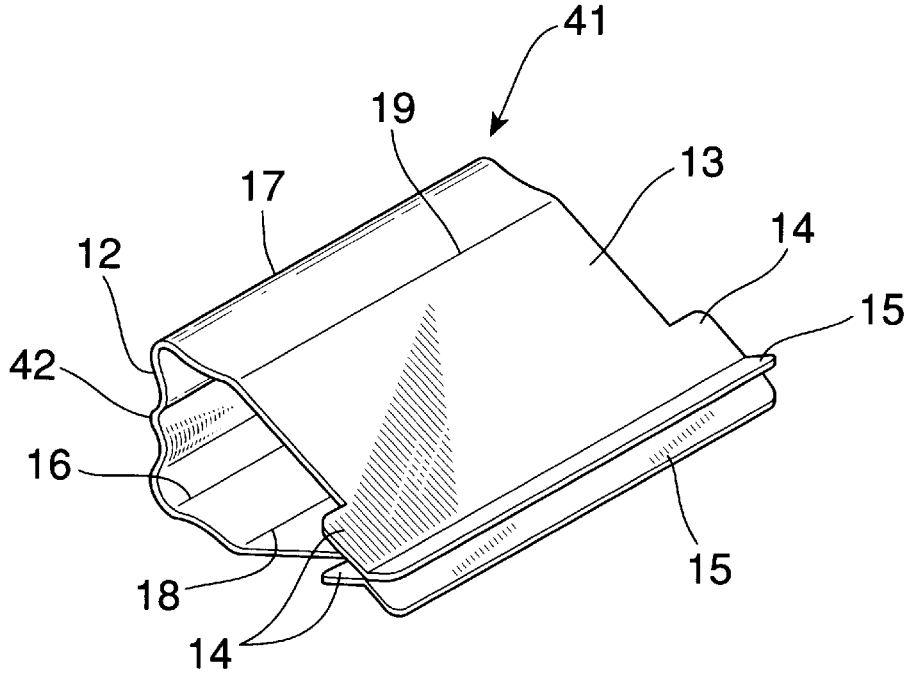
FIG. 8 is a perspective view illustrating a clip according to a fourth embodiment of the present invention.

A fourth embodiment shown in FIG. 8 will be described. FIG. 8 is a perspective view illustrating a clip according to the fourth embodiment. In a clip 41 according to the fourth embodiment, first to fourth bent portions 16 to 19 are formed in the same manner as that in the above-mentioned first embodiment, and in addition to those four bent portions 16 to 19, a fifth bent portion 42 is also formed substantially at the center of a back portion 12. Consequently, an elastic force to make the abutment portions 13 abut against each other is given by the five bent portions 16 to 19 and 42, and each of the bent portions may have an elastic force substantially corresponding to one fifth of the required total elastic force. Therefore, if every bent portion is bent in advance to generate an elastic force which is substantially a little stronger than one fifth of the required total elastic force, the respective bent portions can be opened still with some strength left, so that there is no fear that settling is generated in the respective bent portions even if an opening force is given to those bent portions so that the abutment portions 13 are opened up to become substantially parallel to each other. Further, the force to open the clip may be weaker than that in the above embodiments.

Figure 9:
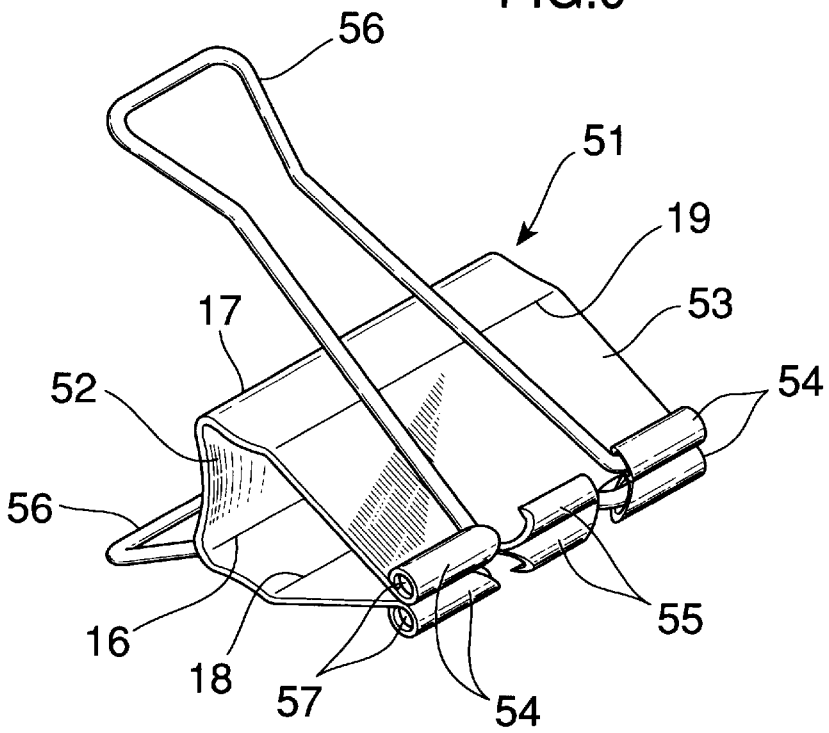
FIG. 9 is a perspective view illustrating a clip according to a fifth embodiment of the present invention.

Next, a fifth embodiment shown in FIG. 9 will be described. FIG. 9 is a perspective view illustrating a clip according to the fifth embodiment. The clip according to the fifth embodiment is a modification of the above-mentioned clip with finger grips. In this finger-grip clip 51, a back portion 52 which has a width, in the longitudinal direction of the belt-like metal plate, substantially corresponding to the maximum clipping thickness and at the center portion and which is curved inward substantially at its widthwise center, and abutment portions 53 which are formed by bending the belt-like metal plate in the same direction at the opposite ends of this back portion 52 respectively so that the forward end portions of the abutment portions 53 abut against each other elastically. On the forward end portion of each of the abutment portions 53, lock portions 54 are formed on the opposite sides by bending the side portions into rings respectively, and an edge 55 is formed between these lock portions 54 by bending the end portion of the abutment portion 53 in the same manner as in a conventional clip like this type. Opposite end portions 57 of each of grips 56 made from hard metal wire are rotatably inserted into the lock portions 54 of each of the abutment portions 53 respectively. More specifically, the opposite end portions 57 of one of the grips 56 are inserted into the two lock portions 54 of one of the abutment portions 53 respectively, and the opposite end portions 57 of the other the grip 56 are inserted into the two lock portions 54 of the other abutment portion 53.

In order to give an elastic force to the abutment portions 53 so that the forward end portions of the abutment portions 53 abut against each other, four bent portions are provided in the same manner in the above first embodiment such that first and second bent portions 16 and 17 are formed in the borders between the opposite ends of the back portion 52 and the respective abutment portions 53 following these opposite ends, and third and fourth bent portions 18 and 19 are formed in the respective abutment portions 53 at equal distances away from these first and second bent portions 16 and 17 respectively.

Therefore, also in this embodiment, the elastic force to make the abutment portions 53 abut against each other is generated by the four bent portions 16 to 19. Therefore, an elastic force of each of the bent portions may be only a quarter of the required total elastic force. If the elastic force of each of the bent portions is set to be stronger than a quarter of the required total elastic force, the respective bent portions 16 to 19 are opened still with some strength left, so that there is no fear that settling is generated in the respective bent portions 16 to 19 even if the finger grips 56 are rotated toward the back portion 52, and both the finger grips 56 are gripped with fingers so that the respective abutment portions 53 are opened up to become substantially parallel to each other as shown in FIG. 9 in order to clip sheet-like members 10 piled up to the thickness substantially corresponding to the maximum clipping thickness. As a result, the original elastic force can be given immediately after the force to open the clip is released, and the forward end portions of the respective abutment portions 53 of the clip 51 abut against each other tightly when the sheet-like members 10 which have a stack thickness substantially corresponding to the maximum clipping thickness and which have been clipped in the clip 51 are removed from the clip 51, with no fear that a gap is generated between the forward end portions of the abutment portions 51. Therefore, the clip with finger grips having no settling can be formed from stainless steel which is weaker in the elastic force but easier in post-treatment than steel, so that the clip can be provided inexpensively. In addition, because an elastic force required for each bent portion may be substantially a little stronger than a quarter of the required total elastic force, a clipping force given to the finger grips 56 to open the respective abutment portions 53 up to become substantially parallel to each other may be also weaker than that in a conventional clip with finger grips.

Figure 10:
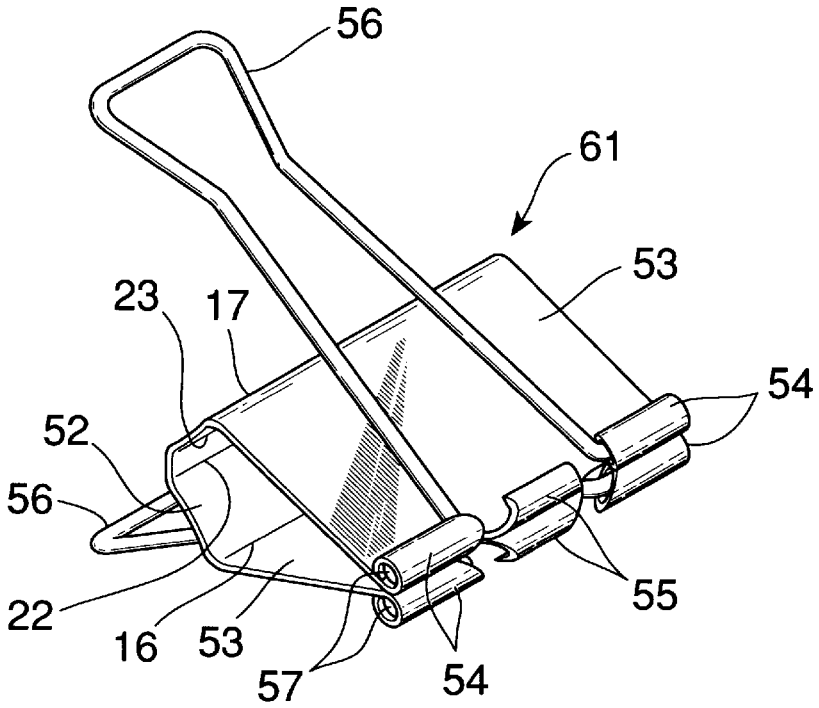
FIG. 10 is a perspective view illustrating a clip according to a sixth embodiment of the present invention.

Next, a sixth embodiment will be described with reference to FIG. 10. FIG. 10 is a perspective view illustrating a clip according to the sixth embodiment. The clip according to the sixth embodiment is also an improvement of the above-mentioned clip with finger grips. In this clip 61 with finger grips, similarly to the second embodiment, a flat-top mountain-like vertex portion projecting outward is formed substantially at the center of a back portion 52, so that third and fourth bent portions 22 and 23 are formed in the borders between the flat-top mountain-like vertex portion and inclined sides on the opposite sides of the vertex portion. Also with this structure, an effect similar to that in the fifth embodiment can be obtained.

Figure 11:
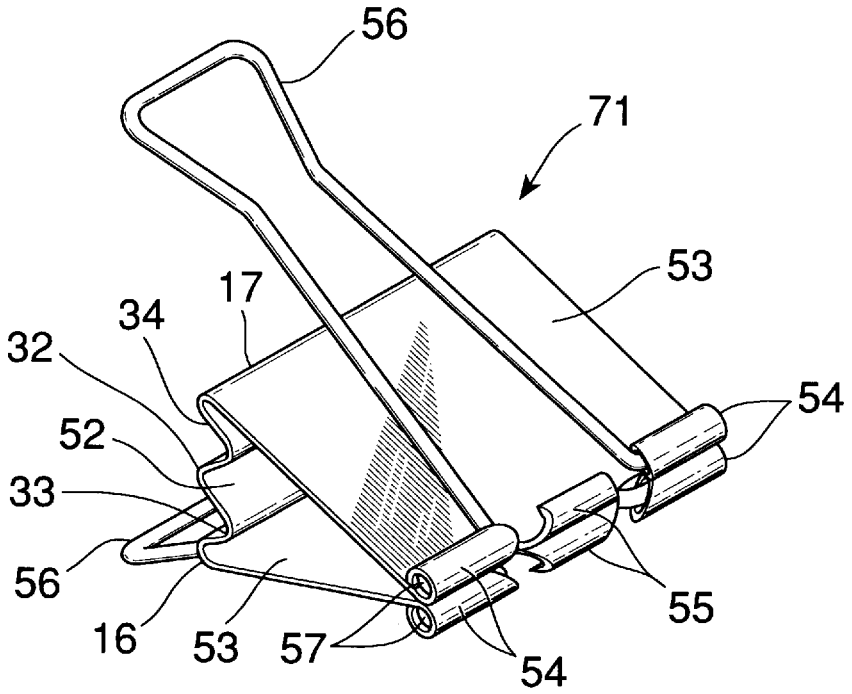
FIG. 11 is a perspective view illustrating a clip according to a seventh embodiment of the present invention.

Next, a seventh embodiment shown in FIG. 11 will be described. FIG. 11 is a perspective view illustrating a clip according to the seventh embodiment. In a clip 71 with finger grips according to the seventh embodiment, similarly to the third embodiment, a mountain-like convex strip 32 projecting outward is provided substantially at the center portion of a back portion 52 and valley-like concave strips 33 and 34 are formed between the convex strip 32 and the first and second bent portions 16 and 17, respectively. Consequently, three wave portions are formed as three bent portions in the back portion 52, so that an elastic force to make abutment portions 53 abut against each other is given by means of these three wave portions. Therefore, if each of these three wave portions is bent in advance to generate an elastic force which is substantially a little stronger than one third of the required total elastic force, the respective wave portions can be opened still with some strength left so that there is no fear that settling is generated in the respective wave portions, even if an opening force is given to the wave portions so that the abutment portions 53 are opened up to become substantially parallel to each other. Further, the clip opening operation can be performed with weak force.

Figure 12:
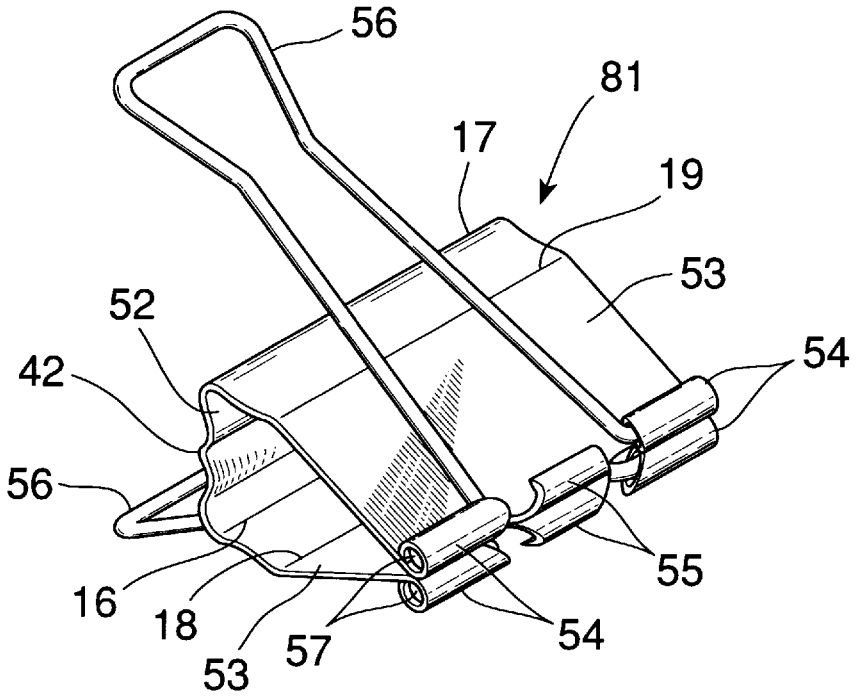
FIG. 12 is a perspective view illustrating a clip according to an eighth embodiment of the present invention.

Next, an eighth embodiment shown in FIG. 12 will be described. FIG. 12 is a perspective view illustrating a clip according to the eighth embodiment. In a clip 81 with finger grips according to the eighth embodiment, similarly to the fourth embodiment, first to fourth bent portions 16 to 19 are formed, and in addition to those four bent portions 16 to 19, a fifth bent portion 42 is also formed substantially at the center of a back portion 52. Consequently, an elastic force to make the abutment portions 53 abut against each other is given by the five bent portions 16 to 19 and 42, and each of the bent portions may have an elastic force substantially corresponding to one fifth of the required total elastic force. Therefore, if every bent portion is bent in advance to generate an elastic force which is substantially a little stronger than one fifth of the required total elastic force, the respective bent portions can be opened still with some strength left, so that there is no fear that settling is generated in the respective bent portions even if an opening force is given to those bent portions so that the abutment portions 13 are opened up to become substantially parallel to each other. Further, the force to open the clip may be further weaker than that in the above fifth to seventh embodiments.

As is clear from the above description, according to a first aspect of the present invention, at least three bent portions are formed so as to give an elastic force to the abutment portions. Thus, the elastic force to make the abutment portions abut against each other is given by these bent portions. Accordingly, it will work well if each of the bent portions has an elastic force corresponding to about one third of the required total elastic force. Therefore, if each of the bent portions is bent in advance to generate an elastic force which is substantially a little stronger than the one third of the required total elastic force, the respective bent portions are opened still with some strength left so that there is no fear that settling is generated in the respective bent portions even if the respective abutment portions are opened up to become substantially parallel to each other.

According to a second aspect of the present invention, four bent portions are formed, so that it will work well if each of the bent portions has an elastic force corresponding to substantially a quarter of the required total elastic force. Therefore, if each of the bent portions is bent in advance to generate an elastic force which is substantially a little stronger than a quarter of the required total elastic force, the respective bent portions are opened still with some strength left so that settling in the respective bent portions can be surely prevented from being generated even if the abutment portions are opened up to become substantially parallel to each other.

According to a third aspect of the present invention, the interior angle forming each of the third and fourth bent portions is made obtuser than the interior angle forming each of the first and second bent portions, so that the abutting edges of the respective abutment portions can press down the surface of sheet-like members to be clipped with a soft elastic force without damaging the surface.

According to a fourth aspect of the present invention, two bent portions are formed at a distance substantially at the center of the back portion, and two bent portions are formed in the borders between the opposite ends of the back portion and the abutment portions following the opposite ends of the back portion respectively. Thus, the four bent portions in total are provided. Also with this structure, an effect equivalent to that according to the second aspect of the present invention can be obtained.

According to a fifth aspect of the present invention, three bent portions are constituted by two bent portions formed in the borders between the opposite ends of the back portion and the abutment portions following the opposite ends of the back portion respectively, and one bent portion formed into a mountain-like protrusion projecting outward substantially at the center of the back portion. Also with this structure, an effect equivalent to that according to the first aspect of the present invention can be obtained.

According to a sixth aspect of the present invention, five bent portions are formed, so that it will work well if each of the bent portions has an elastic force corresponding to about one fifth of the required total elastic force. Therefore, if each of the respective bent portions is bent in advance to generate an elastic force which is substantially a little stronger than the one fifth of the required total elastic force, the bent portions are opened still with some strength left so that settling in the respective bent portions can be surely prevented from being generated even if the abutment portions are opened up to become substantially parallel to each other.

According to a seventh aspect of the present invention, as the material for the clip used is a metal plate made from stainless steel which is rust-resistant enough to be shipped as a product with no surface treatment such as plating, etc. Accordingly, the clips can be provided inexpensively.

According to an eighth aspect of the present invention, the lug portions are provided at side edges of the abutment portions, so that it is possible to provide a clip which can be used with the above-mentioned clip driver, in which there is no fear that settling is generated even if sheet-like members having a stack thickness corresponding to the maximum clipping thickness of the clip are clipped, and in which the load applied to the opening springs of the clip driver is reduced.

According to a ninth aspect of the present invention, the opposite ends of each of the finger grips provided for opening the abutment portions are rotatably inserted into lock portions formed on the abutting edge of each of the abutment portions. Accordingly, not only the opening force of the finger grips to open the abutment portions can be reduced in comparison with a conventional clip with finger grips, but also the respective bent portions are opened still with some strength left so that there is no fear that settling is generated in the respective bent portions. Therefore, stainless steel which can be shipped as products without effecting any surface treatment such as plating, etc., can be used as a material for the metal plate of the clips so that clips can be provided inexpensively.

What is claimed is:

1. A clip made from a band-like metal plate having spring characteristics, comprising:

a back portion formed at a center portion of said metal plate in its longitudinal direction so as to have a width in said longitudinal direction corresponding to a maximum clipping thickness of said clip;

a pair of abutment portions formed by bending said band-like metal plate in a same direction at longitudinally opposite ends of said back portions, said abutment portions having abutting edges at portions away from the back portion which contact, push and abut against each other for holding sheet-like members to be clipped between said abutting edges of said abutment portions; and first, second, third and fourth bent portions for providing an elastic force to said abutment portions, said first and second bent portions being formed at borders between longitudinal opposite ends of said back portion and said third and fourth bent portions being formed at portions in said respective abutment portions away from said first and second bent portions by equal distances, said first and third bent portions being arranged substantially parallel to said second and fourth bent portions.

2. A clip according to claim 1, wherein said metal plate is made from stainless steel.

3. A clip according to claim 1, wherein lug portions are formed at said abutting edge of each of said abutment portions so as to project from opposite side edges of said abutting edge outward perpendicularly to said longitudinal direction.

4. A clip according to claim 1, wherein said clip further comprises a pair of finger grips formed from linear members for opening said abutting edges of said abutment portions, said finger grips being attached to said abutment portions in a manner so that lock portions are formed in a direction perpendicular to said longitudinal direction at said abutting edge of each of said abutment portions and opposite ends of each of said finger grips are rotatably inserted into said lock portions of each of said abutment portions.

5. A clip according to claim 1, wherein a portion sandwiched between the first and third bent portions is substantially parallel to a portion sandwiched between the second and fourth portions.

6. A clip according to claim 5, wherein said abutting edges extend parallel to each other to abut against each other along the entire length thereof.

7. A clip made from a band-like metal plate having spring characteristics, comprising:

a back portion formed at a center portion of said metal plate in its longitudinal direction so as to have a width in said longitudinal direction corresponding to a maximum clipping thickness of said clip;

a pair of abutment portions formed by bending said band-like metal plate in a same direction at longitudinally opposite ends of said back portion so that longitudinal opposite ends of said respective abutment portions form abutting edges which abut against each other for holding edge portions of sheet-like members to be clipped between said abutting edges of said abutment portions; and at least three bent portions for providing an elastic force to said abutment portions, said bent portions including first, second, third and fourth bent portions, said first and second bent portions being formed at borders between longitudinally opposite ends of said back portion and said pair of abutment portions following said back portion, said third and fourth bent portions being formed at portions in said respective abutment portions away from said first and second bent portions by equal distances respectively, an interior angle of each of said third and fourth bent portions being obtuser than an interior angle of each of said first and second bent portions.

8. A clip made from a band-like metal plate having spring characteristics, comprising:

a back portion formed at a center portion of said metal plate in its longitudinal direction so as to have a width in said longitudinal direction corresponding to a maximum clipping thickness of said clip;

a pair of abutment portions formed by bending said band-like metal plate in a same direction at longitudinally opposite ends of said back portion so that longitudinal opposite ends of said respective abutment portions form abutting edges which abut against each other for holding edge portions of sheet-like members to be clipped between said abutting edges of said abutment portions; and at least three bent portions for providing an elastic force to said abutment portions, said bent portions including first, second, third and fourth bent portions, said first and second bent portions being formed in borders between longitudinally opposite ends of said back portion and said pair of abutment portions following said back portion, said third and fourth bent portions being formed at a distance substantially in a center portion of said back portion.

9. A clip made from a band-like metal plate having spring characteristics, comprising:

a back portion formed at a center portion of said metal plate in its longitudinal direction so as to have a width in said longitudinal direction corresponding to a maximum clipping thickness of said clip;

a pair of abutment portions formed by bending said band-like metal plate in the same direction at longitudinally opposite ends of said back portion so that longitudinal opposite ends of said respective abutment portions form abutting edges which abut against each other for holding edge portions of sheet-like members to be clipped between said abutting edges of said abutment portions; and at least three bent portions for providing an elastic force to said abutment portions, said bent portions including first, second and third bent portions, said first and second bent portions being formed in borders between longitudinally opposite ends of said back portion and said pair of abutment portions following said back portion, said third bent portion being formed into a mountain-like shape projecting outward substantially at a center of said back portion.

10. A clip made from a band-like metal plate having spring characteristics, comprising:

a back portion formed at a center portion of said metal plate in its longitudinal direction so as to have a width in said longitudinal direction corresponding to a maximum clipping thickness of said clip;

a pair of abutment portions formed by bending said band-like metal plate in a same direction at longitudinally opposite ends of said back portion so that longitudinal opposite ends of said respective abutment portions form abutting edges which abut against each other for holding edge portions of sheet-like members to be clipped between said abutting edges of said abutment portions; and at least three bent portions for providing an elastic force to said abutment portions, said bent portions including first, second, third, fourth and fifth bent portions, said first and second bent portions being formed in borders between longitudinally opposite ends of said back portion and said pair of abutment portions following said back portion, said third and fourth bent portions being formed at a distance substantially in a center portion of said back portion, said fifth bent portion being formed into a mountain-like shape projecting outward substantially at a center of said back portion.

* * * * *